United States Patent [19]

Slator

[11] Patent Number: 4,836,064

[45] Date of Patent: Jun. 6, 1989

[54] JAWS FOR POWER TONGS AND BACK-UP UNITS

[76] Inventor: Damon T. Slator, 5629 Sugar Hill, Houston, Tex. 77056

[21] Appl. No.: 74,143

[22] Filed: Jul. 16, 1987

Related U.S. Application Data

[63] Continuation-in-part of Ser. No. 36,592, Apr. 10, 1987.

[51] Int. Cl.[4] ..... B25B 17/00

[52] U.S. Cl. ..... 81/57.18; 81/57.15

[58] Field of Search ..... 81/57.15–57.21, 81/57.33, 57.34; 269/264, 266, 267, 275, 277

[56] References Cited

U.S. PATENT DOCUMENTS

| | | | |
|---|---|---|---|
| Re. 31,699 | 10/1984 | Eckel . | |
| Re. 31,993 | 10/1985 | Wesch, Jr. . | |
| 1,811,666 | 12/1929 | Foster . | |
| 2,668,689 | 2/1954 | Cormany . | |
| 3,589,742 | 6/1971 | Flick | 81/57.18 X |
| 3,599,960 | 8/1971 | Phillips . | |
| 3,776,320 | 12/1973 | Brown . | |
| 3,858,468 | 1/1975 | Pasbrig . | |
| 4,077,250 | 3/1978 | Wesch . | |
| 4,084,453 | 4/1978 | Eckel . | |
| 4,089,240 | 5/1978 | Eckel . | |
| 4,215,602 | 8/1980 | Carstensen . | |
| 4,250,773 | 2/1981 | Haynes et al. | 81/57.18 |
| 4,276,771 | 7/1981 | Wesch, Jr. . | |
| 4,281,535 | 8/1981 | Wesch, Jr. . | |
| 4,334,444 | 6/1982 | Carstensen . | |
| 4,350,062 | 9/1982 | Farr . | |
| 4,372,026 | 2/1983 | Mosing . | |
| 4,401,000 | 8/1983 | Kinzbach . | |
| 4,593,584 | 6/1986 | Neves . | |
| 4,649,777 | 3/1987 | Buck | 81/57.19 |
| 4,709,599 | 12/1987 | Buck | 81/57.18 |

FOREIGN PATENT DOCUMENTS

| | | | |
|---|---|---|---|
| 2235285 | 7/1971 | Fed. Rep. of Germany | 269/275 |

*Primary Examiner*—Debra Meislin

*Attorney, Agent, or Firm*—Pravel, Gambrell, Hewitt, Kimball & Krieger

[57] ABSTRACT

An improvement is made to jaw designs for power tongs and back-up units. The jaw is formed having a cavity whose opening is oriented toward the pipe to be gripped. An elongated die is movably mounted in the cavity effectively closing off the cavity. The die has a gripping surface adapted to contact the pipe. A resilient member, preferably synthetic rubber or other elastomer or a substantially incompressible fluid, is disposed within the cavity adjacent the die. Uneven loads on the die are redistributed through the hydraulic action of the resilient member with a resultant equal distribution of the loads on the die.

11 Claims, 3 Drawing Sheets

JAWS FOR POWER TONGS AND BACK-UP UNITS

This application is a continuation-in-part of Application Ser. No. 036,592 filed Apr. 10, 1987, entitled JAWS FOR POWER TONGS AND BUCKING UNITS.

FIELD OF THE INVENTION

This invention relates to the field of jaws for power tongs and back-up units. Power tongs and back-up units are used to couple and uncouple pipe sections, predominantly in the well-drilling and production fields.

BACKGROUND OF THE INVENTION

The basic design features of power tongs and back-up units having guided jaws is illustrated in U.S. Pat. No. Re. 31,699, re-issued Oct. 9, 1984 and invented by Emory L. Eckel. The basic configuration for this type of unit included an open end through which a pipe was inserted into the back-up unit. The frame contained a member having a camming surface thereon. Concentrically nested within this member was a spider. Slidably mounted within slots within the spider were jaws whose rollers tracked the camming surface. When relative motion between the member having the camming surface and the spider occurred, radial displacement of the jaw within said slots would occur until the jaws were radilly displaced and a die contacted the pipe.

Since power tongs and back-up units operate in a fairly dirty environment, the clearance within the spider must be sufficient to prevent jamming of the jaw members due to foreign matter which may become lodged in the clearance. The purpose of the spider and clearance combination was also to provide a guide for the jaw. However, due to the clearance employed to prevent jamming of the jaw, the spider, in practice, did not guide the jaw at all. In fact, to achieve any guiding effect by the spider, the jaw is required to pivot within the clearance. The only way the jaw could pivot was first to gouge or deform the pipe.

Upon contact between the die rigidly mounted in the jaw and the pipe, further rotational movement of the jaw was possible due to the clearance. This further movement after initial contact of the die with the pipe, in effect, resulted in a very high load at the leading end of the die. This phenomenon caused damage to the outer pipe wall, and in some cases, physically deformed the pipe due to the excessive line loads applied.

It is the object of this invention to improve the jaw design in a guided jaw power tong or back-up unit such that there is close to an equally distributed load applied to the pipe. It is another object of this invention to movably mount the die to the jaw in an effort to equalize the loads applied by the die mounted to the jaw on the pipe. It is yet another object of this invention to actually use the spider as a guide for the jaw, while at the same time, using movably mounted dies mounted to the jaw. The guiding of the spider coupled with the movable mounting of the die prevents the possibility of the die deforming the pipe and/or gouging the pipe surface.

SUMMARY OF THE INVENTION

An improvement is made to jaw designs for power tongs and back-up units. The jaw is formed having a cavity whose opening is oriented toward the pipe to be gripped. An elongated die is movably mounted in the cavity effectively closing off the cavity. The die has a gripping surface adapted to contact the pipe. A resilient member, preferably synthetic rubber or other elastomer or a substantially incompressible fluid such as liquid, is disposed within the cavity adjacent the die. Uneven loads on the die are redistributed through the hydraulic action of the resilient member with a resultant equal distribution of the loads on the die.

DETAILED DESCRIPTION OF THE PERFERRED EMBODIMENT

The basic components of power tongs and back-up units were described in earlier filed and co-pending application Ser. No. 036,592, filed Apr. 10, 1987, entitled JAWS FOR POWER TONGS AND BUCKING UNITS, which is incorporated by reference herein as if fully set forth.

Figure 1:
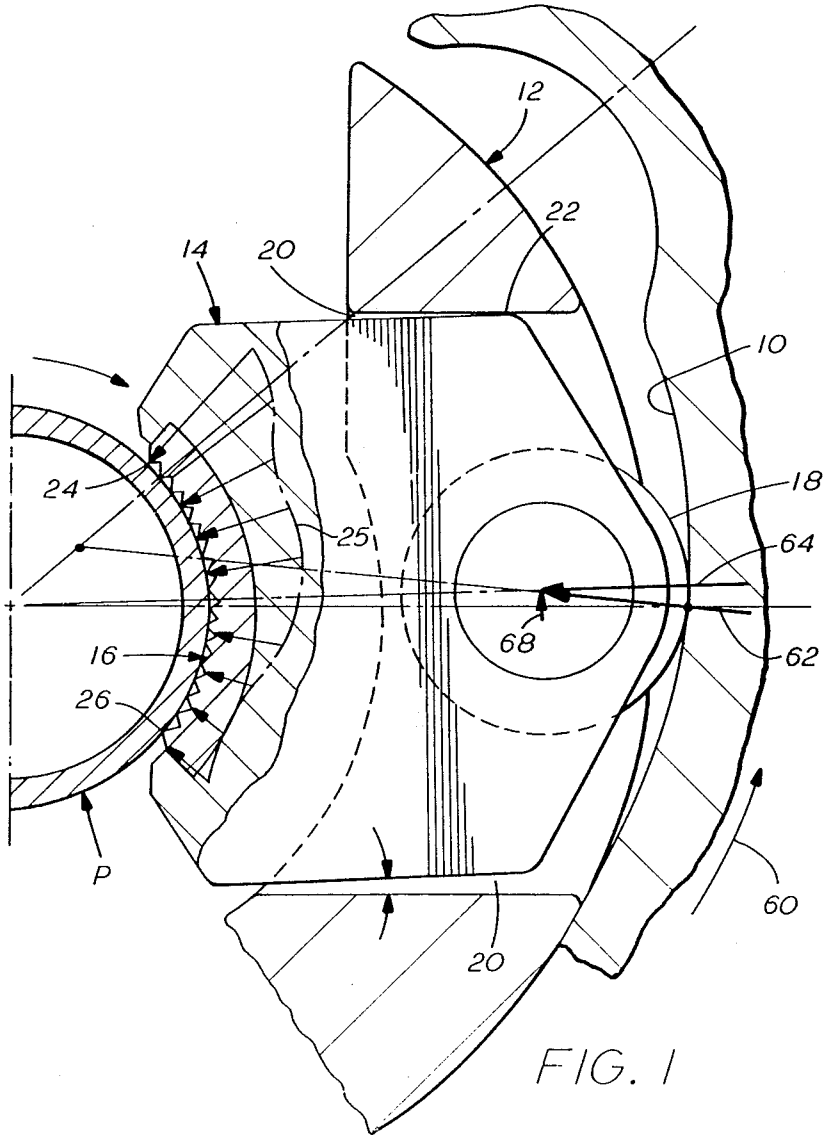
FIG. 1 illustrates a guided jaw design for a power tong or back-up unit as used in the prior art.

The basic structure of power tongs and back-up units involving guided jaws is illustrated in U.S. Pat. No. Re. 31,699, invented by Eckel. Eckel's design is shown in detail in FIG. 1. The major components are a camming surface 10, a spider 12, a jaw 14, a die 16, and a roller 18. It is understood that the Eckel U.S. Pat. No. Re. 31,699 uses a pair of discrete dies having a relatively short arcuate length mounted to each jaw. The die design 16 shown in FIG. 1 is termed a wrap-around die and has also been used in the prior art in a rigid mounting to a jaw 14. Generally, a plurality of jaws 14 are mounted in the spider 12 to grip the pipe P for applying a torque thereto, as in the case of a power tong, or for retaining the pipe stationary, as in the case of a back-up unit.

Generally, the power tong or back-up unit comprises a frame (not shown) in which the camming surface 10 is mounted. The camming surface 10 can be movably mounted to the frame. Depending on the design, either the movable member having the camming surface 10 or the spider 12 is actuated. The result is relative movement between the camming surface 10 and the spider 12. For example, a light mechanical drag can be applied to the spider 12 while the member having the camming surface 10 is driven. Alternatively, the spider 12 can be driven relative to the stationary camming surface. As a result, there is movement of camming surface 10 with respect to spider 12 which, due to the interaction between roller 18 and the camming surface 10, results in radial movement of jaw 14 until die 16 contacts pipe P. In order to allow the jaw 14 to slide with respect to spider 12, a clearance 20 must be provided on either side of jaw 14. The reason for the clearance is that the power tong or back-up unit operates in a fairly dirty environment. Therefore, in order to prevent jamming of the jaw 14 against the spider 12, a sufficient clearance needs to be provided to account for any foreign objects that may lodge themselves between the jaw 14 and the spider 12. The design intent was to guide the jaw 14 by using the slots within the spider 12. Such prior art design did not fulfill this purpose, since under high load it was possible for the pipe to be gouged due to pivoting of the jaw about its vertical axis within the clearance.

Since there is a slight mechanical drag placed on spider 12, the initial movement of jaw 14 is substantially entirely radial unitl die 16 contacts pipe P. After contact between die 16 and pipe P, further movement of the member having camming surface 10 forces the jaw 14 to contact the spider 12 at a point 22, after which the jaw 14 and the spider 12 move in tandem. However, until contact between die 16 and pipe P, there is no rotational motion of spider 12 or torque applied to pipe P. As shown in FIG. 1, when the die 16 contacts pipe P there is an initial contact established at point 22. In effect, the jaw 14 is shifted within the clearance until there is contact with the spider 12 at point 22. Upon additional application of torque as a result of moving the camming surface 10, there is a tendency for the die 16 to either gouge the pipe or deform it, since, in effect, jaw 14 is not guided due to clearance 20, as illustrated on the side of jaw 14 opposite that from contact point 22.

The disadvantageous result of this construction is shown graphically in FIG. 1. The leading edge 24 applies a fairly concentrated line load onto the pipe P. As graphically illustrated by line 25, the force distribution is such that the maximum force against the pipe P is seen along the toe 24 with a gradual decreasing of force applied to pipe P until the end or heel 26 of die 16.

Figure 2:
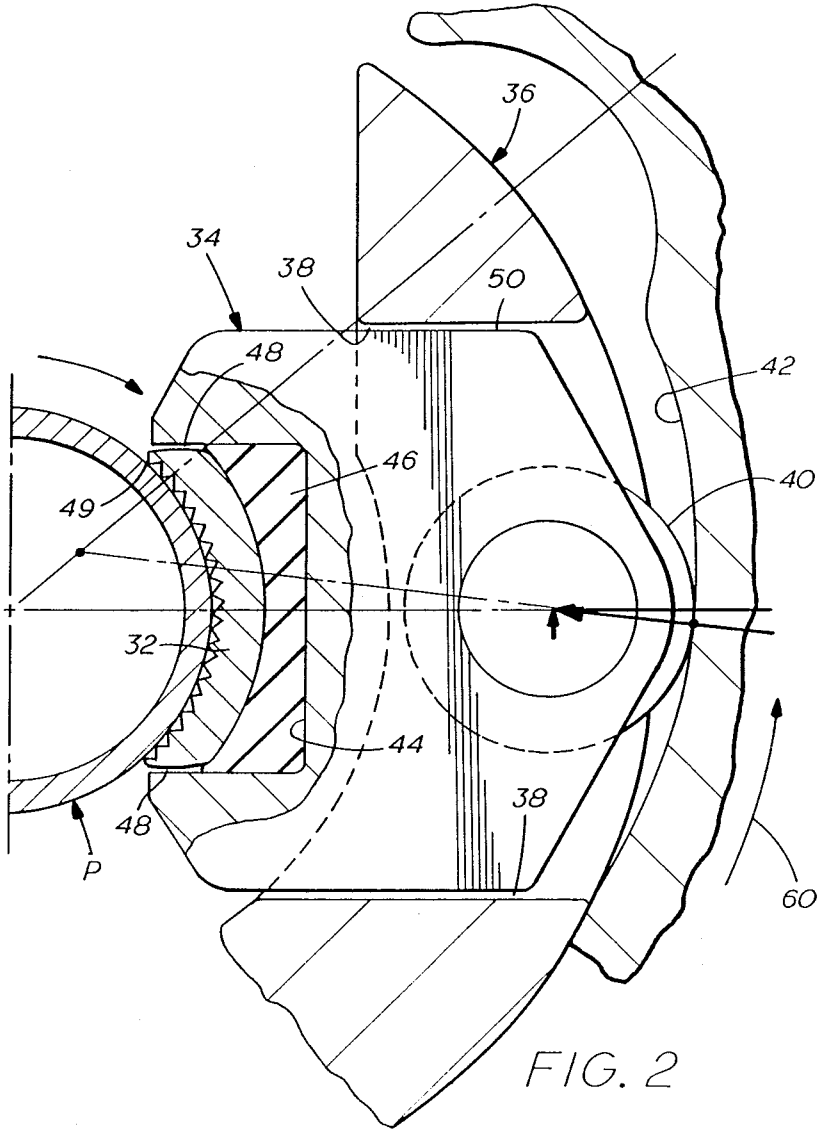
FIG. 2 illustrates the jaw of the present invention at the point of initial contact between the pipe and the die.

The apparatus A of the present invention is illustrated in FIG. 2 in a condition where the die 32 has made initial contact with the pipe P before any torque is applied.

Die 32 is mounted to jaw 34. Jaw 34 is guided by spider 36. There is a clearance 38 between spider 36 and jaw 34. Jaw 34 is mounted on a roller 40 which rolls with respect to camming surface 42.

As previously stated with respect to FIG. 1, relative movement between camming surface 42 and spider 36 results in radial movement of jaw 34 with respect to spider 36 until die 32 contacts pipe P.

Die 32 is mounted within a cavity 44 in jaw 34. The cavity 44 has an opening which faces the pipe P. Filling cavity 44 behind die 32 is a resilient material 46 such as synthetic rubber, for example. The cavity can alternatively be filled with an incompressible fluid without departing from the spirit of the invention. There is preferably a slight clearance 48 between the die 32 and the jaw 34.

Initial movement of camming surface 42 with respect to spider 36 results in a rolling action of roller 40 on camming surface 42 and a resultant radial movement of jaw 34. Jaw 34 continues to move radially until the die 32 contacts pipe P. As jaw 34 moves radially to the position shown in FIG. 2, there is a sliding contact between the jaw 34 and the spider 36. After engagement of the die 32 on the pipe P, further movement of camming surface 42 displaces the jaw 34 and spider 36 in tandem.

Further displacement of the jaw 34 after initial contact of the die 32 to the pipe P results in transmission and resultant equalization of forces acting on die 32 by virtue of the presence of resilient material 46 directly behind die 32. There is, in effect, a phenomenon similar to hydraulic force distribution where application of an uneven force on the die 32 results in its subsequent even distribution by virtue of the resilient material 46 behind die 32 equalizing the applied load to pipe P along the entire length of die 32. The design in FIG. 2 employs clearance 38 substantially identical to the clearance 20 in FIG. 1. However, due to the use of the resilient material 46 in cavity 44, the load is substantially evenly distributed, along the length of die 32 shortly after the point of initial contact of die 32 as shown in FIG. 2. As a result, application of further torque allows jaw 34 to rotate slightly about its vertical axis with respect to die 32 until the jaw 34 is stopped by spider 36. To make this motion possible, as seen, for example in FIG. 6, ends 52 and 54 have a slight arcuate shape in combination with a small clearance 48 which allows the relative rotational movement of the jaw 34 with respect to the die 32. Unlike the prior art, the spider 36 effectively acts as a guide to jaw 34 limiting the extent of its rotation by use of resilient material 46 coupled with a movably mounted die 32. Rotation of the jaw 34 within clearance 38 continues until the jaw 34 contacts the spider 36 on two opposing sides of the slot within which it is mounted. However, such rotation can be tolerated without damge to pipe P.

Figure 4:
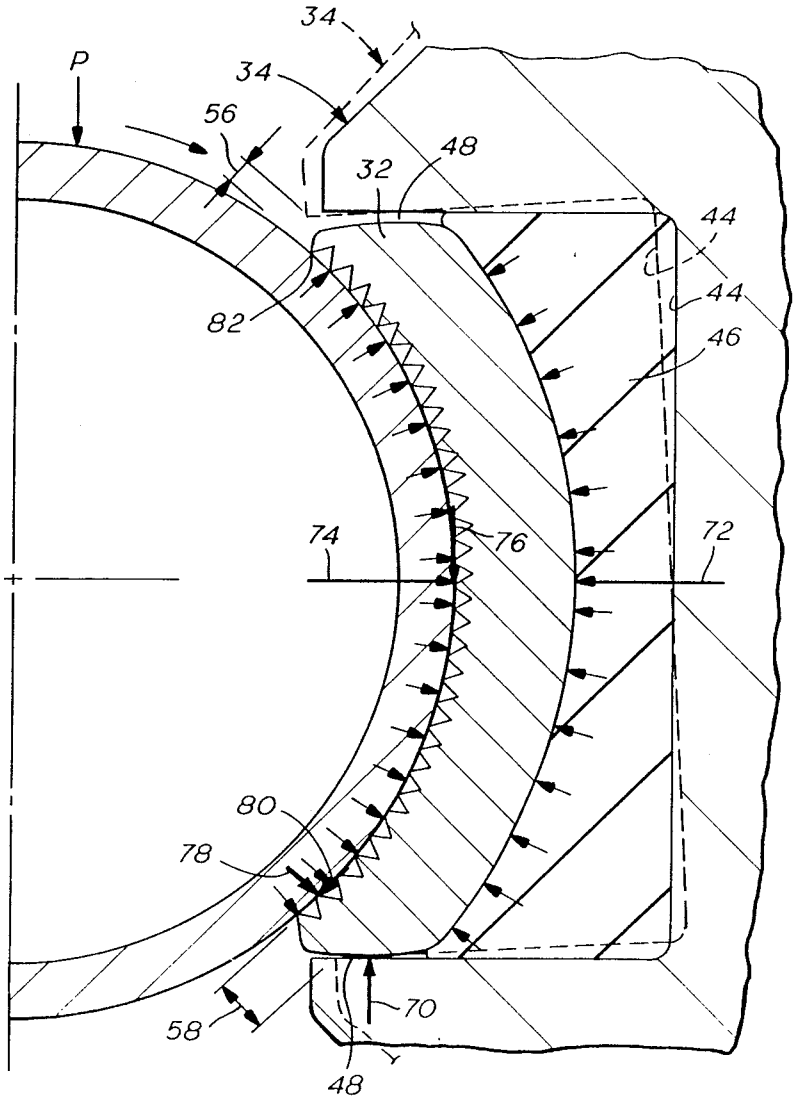
FIG. 4 is a detailed view of the die mounted to the jaw shown in FIGS. 2 and 3.
Figure 3:
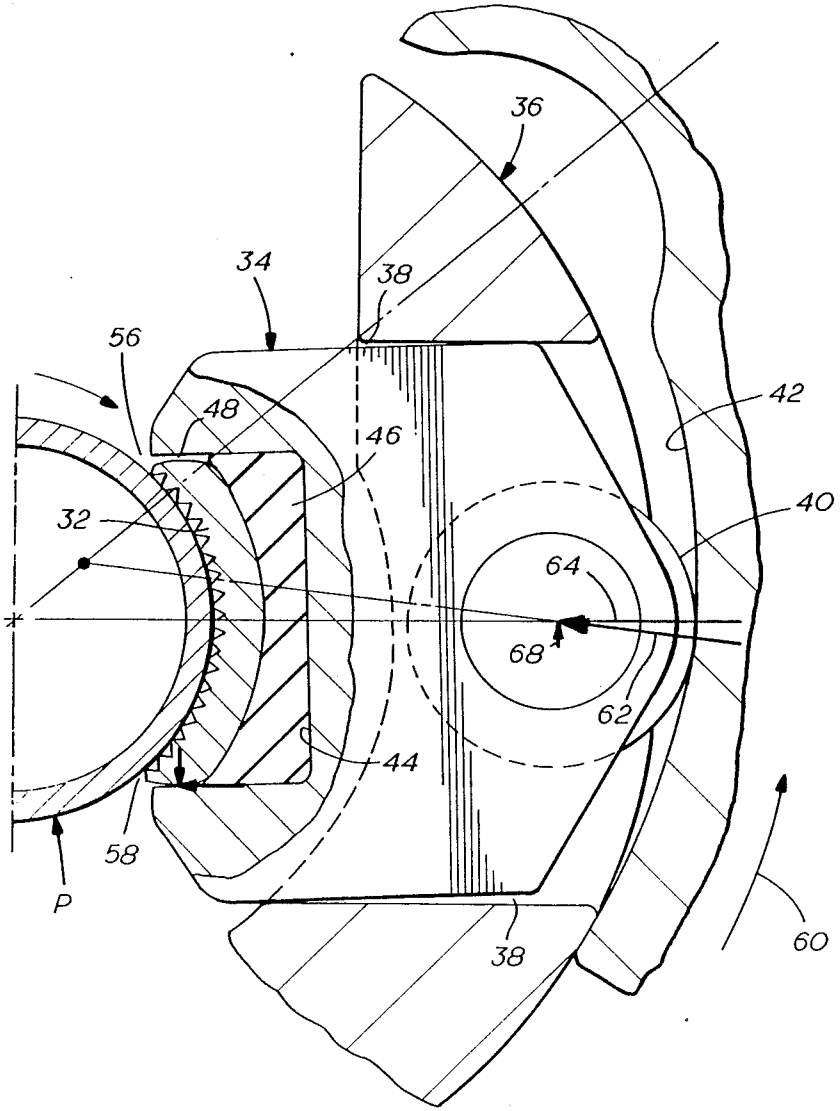
FIG. 3 illustrates the position of the jaw with respect to the pipe after torque has been applied to the pipe.

The end position of the jaw 34 with respect to the pipe P is illustrated in FIGS. 3 and 4. As seen in FIG. 3 the clearance 56 is smaller than the clearance 58 as a result of the relative movement of jaw 34 with respect to die 32. Arrow 60 indicates the direction of the applied torque to the camming surface 42. The resultant applied force is indicated by arrow 62. Arrow 62 has a horizontal component 64. The vertical component 68 of the applied force 62 represents the torque applied on pipe P.

FIG. 4 is a detailed view of the die 32 mounted in jaw 34. With a torque applied to pipe P, there is a driving force 70 acting on die 32. Additionally, the sum of the hydraulic pressure forces acting on the die 32 are graphically represented by arrow 72. The forces represented by arrow 72 are countered by a resultant normal force between the pipe P and the die 32 represented by arrow 74.

Forces 72 and 74 are applied in an equal and opposite direction. Friction force 76 is graphically represented as the sum of all the frictional forces due to the pressure forces on the die 32, such forces being represented by arrow 74. The extent of force 76 depends upon the size of force 74 and the coefficient of friction between the pipe P and the die 32.

Further, as a result of the driving force 70 on die 32, a reaction normal and tangential force, 78 and 80 respectively, occur due to the wedging action resulting from force 70. However, in the preferred configuration, approximately ten percent of the total load applied to the die 32 is attributable to force 78. The size of force 70 can be manipulated by alteration of the configuration of the walls of cavity 44. FIG. 4 also illustrates that die 32 can have hardened teeth or a rough surface 82 to improve the gripping of the pipe P by die 32.

The no-load situation is demonstrated in FIG. 4 by the solid lines while the situation under load is shown by the dashed line position. FIG. 4 clearly shows the relative movement of the jaw 34 with respect to the die 32 after initial contact between die 32 and the pipe P.

As seen in FIG. 4, the resilient material 46 fills cavity 44 completely. Movement of die 32 with respect to jaw 34 literally displaces resilient material 46 from one part of cavity 44 to the other with a resulting uniform load applied to the pipe P over the entire gripping surface 82 of die 32.

Figure 6:
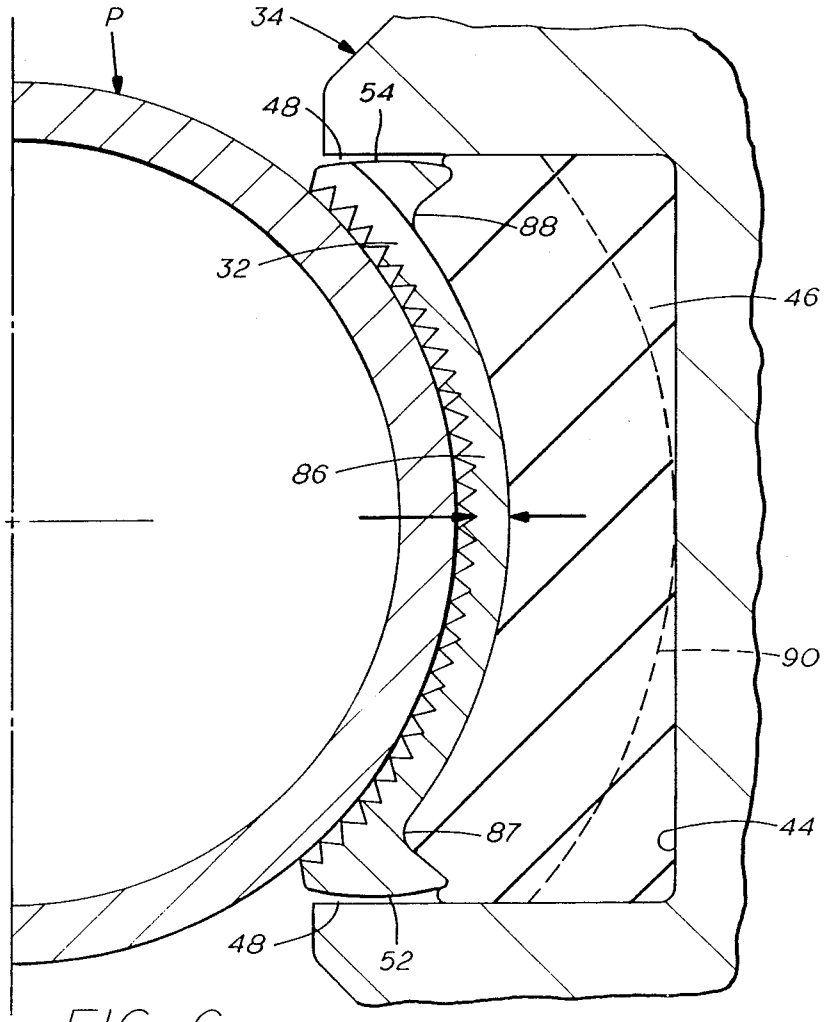
FIG. 6 is an alternative embodiment of the die.
Figure 5:
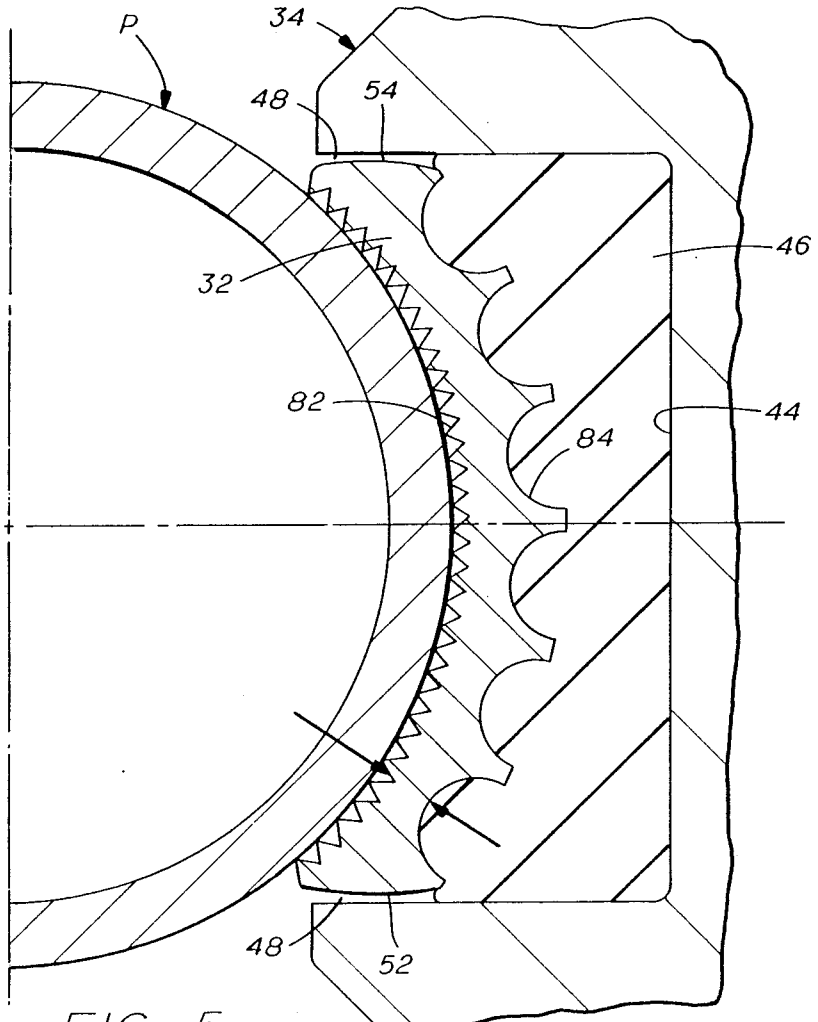
FIG. 5 is an alternative embodiment of the die.

FIGS. 5 and 6 illustrate alternative embodiments of the die 32 as well as cavity 44. In FIG. 5, die 32 has a plurality of flutes 84. The resilient material is preferably bonded to the die 32 and molded to fit closely in cavity 44. The plurality of flutes 84 reduce the stiffness of the die 32. Additionally, die 32 has crowned or arcuate ends 52 and 54 to permit relative motion between die 32 and jaw 34 within cavity 44. Hardened teeth or other rough surface 82 can be employed as the gripping surface for die 32.

The embodiment shown in FIG. 6 provides a reduction in thickness of the central area 86 of die 32 so that the net effective area is sufficient to withstand circumferential compressive loads, but the thickness at the area 86 is not any greater than necessary to withstand such loads, so that the stiffness of the die 32 is minimized. This construction therefore reduces the stiffness of die 32 to a minimum to enable the die 32 to more easily bend to conform to the curvature of the pipe P. To reduce stress concentrations at ends 87 and 88, die 32 has an additional built-up area immediately adjacent to crowned or arcuate ends 52 and 54. It should also be noted that the shape of cavity 44 need not be squared off and may be rounded as shown by dashed line 90. Preferably, the die 32 is bonded to the resilient material 46.

The apparatus A of the present invention offers advantages over prior designs in that the load is equalized over the die 32. Gouging or indentation or excess deformation of the pipe is prevented in the apparatus of the present invention as compared to the high line loads applied at the toe 24 of die 16 in previous designs (FIG. 1). Additionally, with the resilient mounting of die 32, even though there is substantial clearance between the spider 36 and the jaw 34 to avoid jamming therebetween due to foreign objects in the dirty environment, the jaw 34 is capable of limited independent movement relative to the die 32, thereby preventing high line loads at the toe 49 of die 32. Instead, full advantage can be taken of the guiding effect of spider 36 without risk of damage to the pipe P. The movement of die 32 with respect to jaw 34 (FIG. 2) allows for actual guidance of jaw 34 and, coupled with the resilient material 46, allows the apparatus of the present invention to equalize load without the attendant hazard of pipe gouging or excess deformation as found in the prior art (FIG. 1).

The foregoing disclosure and description of the invention are illustrative and explanatory thereof, and various changes in the size, shape and materials, as well as in the details of the illustrated construction may be made without departing from the spirit of the invention.

I claim:

1. In a power tong or back-up unit having a plurality of jaws, each jaw having a roller mounted thereon adapted to engage a camming surface, each jaw guided by guideways in a spider, whereupon relative movement between the camming surface and the spider results in radial movement of said jaws toward a pipe, the improvement in each jaw comprising:

said jaw having a cavity whose opening is oriented toward the pipe to be gripped;

a pipe-gripping die movably mounted in said cavity effectively closing off said cavity, said die having a gripping surface adapted to contact the pipe;

an elastomer means disposed within and filling said cavity behind said die for providing a substantially even distribution of forces, equivalent to force distribution in a confined hydraulic medium, along the entire length of said die upon an uneven force being applied on said die when there is contact between said die and the pipe;

whereupon the pressure applied by said die on the pipe is resultantly substantially uniform over the said gripping surface of said die.

2. The improvement of claim 1, wherein:

said die extends beyond said cavity in said jaw.

3. The improvement of claim 1, wherein:

said die has curved ends in contact with said jaw within said cavity to facilitate angular movement of said jaw with respect to said die after said die has contacted the pipe.

4. The improvement of claim 3, wherein:

said die has a plurality of aligned flutes on a surface opposite said gripping surface, said flutes being embedded in said resilient means.

5. The improvement of claim 3, wherein:

said die has a built up area adjacent said curved ends; and said die has a central section between said curved ends which has a reduced thickness as compared to the area adjacent said curved ends.

6. The improvement of claim 3, wherein:

said gripping surface is formed of hardened teeth.

7. An improved guided jaw for power tongs or back-up unit used to connect and disconnect adjacent lengths of pipe, said jaw comprising:

a cavity whose opening is oriented toward the pipe to be gripped;

a pipe engaging die movably mounted in said cavity effectively closing off said cavity said die having a gripping surface adapted to contact the pipe;

an elastomer means disposed within and filling said cavity behind said die for providing a substantially even distribution of forces, equivalent to force distribution in a confined hydraulic medium, along the entire length of said die upon an uneven force being applied on said die when there is contact between said die and the pipe; and whereupon the pressure applied by said die on the pipe is resultantly substantially uniform over the said gripping surface of said die.

8. The improvement of claim 7, wherein:

said die is formed having curved ends in contact with said jaw within said cavity to facilitate angular movement of said jaw with respect to said die after said die has contacted the pipe.

9. The improvement of claim 8, wherein:

said die is formed having a plurality of aligned flutes on a surface opposite said gripping surface, said flutes being embedded in said resilient member.

10. The improvement of claim 8, wherein:

said die has a built up area adjacent said curved ends;

said die having a central section between said curved ends having a reduced thickness as compared to adjacent said curved ends.

11. The improvement of claim 8, wherein:

said gripping surface is formed of hardened teeth.

* * * * *

UNITED STATES PATENT AND TRADEMARK OFFICE

CERTIFICATE OF CORRECTION

PATENT NO. : 4,836,064

DATED : JUNE 6,1989

INVENTOR(S) : DAMON T. SLATOR

It is certified that error appears in the above-identified patent and that said Letters Patent is hereby corrected as shown below:

Col. 4, line 50 should read "The size of force 78" instead of "The size of force 70".

Signed and Sealed this

Thirteenth Day of February, 1990

*Attest:*

JEFFREY M. SAMUELS

*Attesting Officer*

*Acting Commissioner of Patents and Trademarks*